US005353051A

United States Patent [19]

Katayama et al.

[11] Patent Number: 5,353,051

[45] Date of Patent: Oct. 4, 1994

[54] RECORDING APPARATUS HAVING A PLURALITY OF RECORDING ELEMENTS DIVIDED INTO BLOCKS

[75] Inventors: Akira Katayama, Yokohama; Hideaki Kishida, Yamato; Kimiyuki Hayasaki, Yokohama, all of Japan

[73] Assignee: Canon Kabushiki Kaisha, Tokyo, Japan

[21] Appl. No.: 978,463

[22] Filed: Nov. 19, 1992

Related U.S. Application Data

[63] Continuation of Ser. No. 648,146, Jan. 30, 1991, abandoned.

[30] Foreign Application Priority Data

| | | | |
|---|---|---|---|
| Feb. 2, 1990 | [JP] | Japan | 2-22190 |
| Feb. 2, 1990 | [JP] | Japan | 2-22196 |
| Mar. 23, 1990 | [JP] | Japan | 2-71956 |

[51] Int. Cl.[5] ..... B41J 2/05

[52] U.S. Cl. ..... 347/13; 347/3; 347/14

[58] Field of Search ..... 346/1.1, 140, 139 C; 400/175

[56] References Cited

U.S. PATENT DOCUMENTS

| | | | |
|---|---|---|---|
| 4,313,124 | 1/1982 | Hara | 346/140 R |
| 4,313,684 | 4/1982 | Tazaki | 346/140 R X |
| 4,345,262 | 8/1982 | Shirato et al. | 346/140 R |
| 4,396,923 | 8/1983 | Noda | 346/76 PH |
| 4,447,819 | 5/1984 | Moriguchi et al. | 346/76 PH |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,596,995 | 6/1986 | Yamakawa et al. . | |
| 4,723,129 | 2/1988 | Endo et al. | 346/1.1 |
| 4,740,796 | 4/1988 | Endo et al. | 346/1.1 |
| 4,908,635 | 3/1990 | Iwasawa | 346/140 R |
| 5,038,208 | 8/1991 | Ichikawa | 346/1.1 X |
| 5,039,237 | 8/1991 | Tanuma | 400/175 X |
| 5,157,411 | 10/1992 | Takekoshi | 346/140 R X |

FOREIGN PATENT DOCUMENTS

| | | |
|---|---|---|
| 0245006 | 11/1987 | European Pat. Off. . |
| 0318328 | 5/1989 | European Pat. Off. . |
| 54-56847 | 5/1979 | Japan . |
| 59-123670 | 7/1984 | Japan . |
| 59-138461 | 8/1984 | Japan . |
| 60-71260 | 4/1985 | Japan . |
| 2090030 | 6/1982 | United Kingdom . |

OTHER PUBLICATIONS

Lonis, Robert A; Storage of Operating Parameters In Memory Integral With Printhead, Xerox Disclosure Journal, vol. 8, No. 6 N/D 1983, p. 503.

*Primary Examiner*—Joseph W. Hartary

[57] ABSTRACT

A recording apparatus performing image recording on a recording medium by driving a recording head having a plurality of recording elements. The recording apparatus has a storing device and a driving device. The storing device prestores a drive condition for each respective one of blocks which are formed by dividing the recording elements into a plurality of groups. The driving device simultaneously drives the recording elements in the same block according to the drive condition read from the recording device. In a preferred embodiment, the recording apparatus has recording portions each of which prerecords a pattern representing an index of energy to be fed to the electrothermal transducers of each respective one of the blocks, and a read device for reading out the index of energy from the recording portion via driver circuit.

12 Claims, 15 Drawing Sheets

| DRIVE INDICES | | | | PULSE WIDTH |
|---|---|---|---|---|
| C3 | C2 | C1 | C0 | |
| × | × | × | × | − 1.6 μS |
| × | × | × | ○ | − 1.4 |
| × | × | ○ | × | − 1.2 |
| × | × | ○ | ○ | − 1.0 |
| × | ○ | × | × | − 0.8 |
| × | ○ | × | ○ | − 0.6 |
| × | ○ | ○ | × | − 0.4 |
| × | ○ | ○ | ○ | − 0.2 |
| ○ | × | × | × | ± 0 |
| ○ | × | × | ○ | + 0.2 μS |
| ○ | × | ○ | × | + 0.4 |
| ○ | × | ○ | ○ | + 0.6 |
| ○ | ○ | × | × | + 0.8 |
| ○ | ○ | × | ○ | + 1.0 |
| ○ | ○ | ○ | × | + 1.2 |
| ○ | ○ | ○ | ○ | + 1.4 |

○ ----- CUT OFF

× ----- NOT CUT OFF

FIG. 11

RECORDING APPARATUS HAVING A PLURALITY OF RECORDING ELEMENTS DIVIDED INTO BLOCKS

This application is a continuation of application Ser. No. 07/648,146 filed Jan. 30, 1991, abandoned.

BACKGROUND OF THE INVENTION

1. Field of the Invention

The present invention relates to a recording method and apparatus such as an ink jet recording apparatus or a thermal recording apparatus which forms images by driving a recording head having a plurality of recording elements.

More specifically, the present invention relates to a recording method and apparatus which is preferably applicable to apparatuses using as recording elements, thermal elements having thermal resistors and electrodes connected to the thermal resistors. One of those apparatuses is an ink jet recording apparatus that has thermal elements disposed in liquid passages, and ink ejection outlets disposed on the surface of the recording head and communicating to the liquid passages.

2. Description of the Prior Art

Recently, the ink jet recording method has been increasingly attracting attention. This is because of its various advantages which are conventionally known: noise during recording is very low; color recording can be easily achieved by this technique; and recording to common paper can be carried out.

Above all, an ink jet recording apparatus which uses thermal energy for recording attracts particular attention because its size can be easily reduced, and the high density alignment of the ink ejection outlets is possible. The ink jet recording apparatus performs recording as follows: thermal elements provided in the liquid passages communicate to minute ink ejection outlets from which ink is ejected and heated by electric currents; and the ink is ejected from the ejection outlets in the form of ink droplets by using the sudden volume change involved in the bubbling of the ink around the thermal elements, which is caused by heating.

In this type of ink jet recording apparatus using thermal energy, the recording head is usually provided with a plurality of ink ejection outlets which are integrally aligned in a certain direction. For example, a so-called full line type recording head in which the ink ejection outlets are aligned over the full length across the width of a recording medium such as a sheet of paper, an OHP sheet or a sheet of cloth, the thermal elements are driven all at once, or block by block consisting of a certain number of the thermal elements by applying voltage pulses of a certain width in sequence. In general, it is important to control the pulse width so that each pulse gives just sufficient thermal energy for ejecting ink so that excess thermal energy is not produced. This is important not only for energy saving but also for stabilizing the ink ejection in the course of the repetitive drive of the recording head. Such a driving technique is also used by the recording head of a thermal recording apparatus.

The resistances of the thermal elements laminated on a substrate, however, are not uniform. As a result, amounts of heat generation of the thermal elements vary according to the variation in resistances of the thermal elements. This causes the volume change of the ink at bubbling to vary for respective thermal elements, the quantity of ejected ink to vary, thereby making the diameters of dots different, which will deteriorate the quality of recorded images. This problem holds true of other recording apparatus such as a thermal recording apparatus .

Furthermore, in conventional ink jet recording apparatuses or thermal recording apparatuses, all the thermal elements in the head are driven by pulses of the same width having the same drive voltage. This presents a problem that not all the thermal elements are driven by the optimum drive condition: to some thermal elements, more than sufficient energy is applied, thereby shortening the life of the thermal elements; whereas, to other elements, less than necessary energy is applied, thereby destabilizing the ejection of the ink by the thermal elements.

Moreover, in a recording head which is provided with a number of ink ejection outlets aligned in the direction of printing, for example, as in a recording head of a so-called full-multi-type recording head in which the ink ejection outlets are aligned over the full length across the recording paper, the variation in the resistances of the thermal elements further increases, which presents a problem that the stability of the ink ejection is further deteriorated.

SUMMARY OF THE INVENTION

It is therefore an object of the present invention, in view of the above problems, to provide a recording method and apparatus that can achieve high quality record images by making it possible to perform optimum control of the thermal element drive.

In a first aspect of the present invention, there is provided a recording method which performs image recording on a recording medium by driving a recording head having a plurality of recording elements, the recording method comprising the steps of: dividing the recording elements into a plurality of blocks, the recording elements in the same block being simultaneously driven; prestoring a drive condition for each respective one of the blocks; and recording an image on the recording medium by simultaneously driving the recording elements in the block according to the drive condition previously stored.

In a second aspect of the present invention, there is provided with a recording apparatus, which performs image recording on a recording medium by driving a recording head having a plurality of recording elements. The recording apparatus comprises a storing means for prestoring a drive condition for each respective one of blocks which are formed by dividing the recording elements into a plurality of groups, the recording elements in the same block being simultaneously driven; and driving means for simultaneously driving the recording elements in the block according to the drive condition read from the storing means.

According to one aspect of the present invention, there is provided a recording apparatus having, on the same substrate, a plurality of electrothermal transducers for generating recording energy, and a driver circuit which drives the plurality of electrothermal transducers block by block, where the electrothermal transducers are divided with controlling electric currents flowing through the electrothermal transducers, and performing image recording on a recording medium with a recording head by flowing the electric currents through the electrothermal transducers. The recording apparatus comprises a plurality of recording portions formed on the substrate, each of which prerecords a pattern representing an index of energy to be fed to the electrothermal transducers of each respective one of the blocks; and read means for reading out the index of energy from the recording portion via the driver circuit.

According to a more specific aspect of the invention, the index of energy is set according to an average resistance of the electrothermal transducers of each block, the average resistance being obtained on the basis of measured data, and the electrothermal transducers of each block are driven with drive pulses of a pulse width corresponding to the index of energy read out by the read means.

According to the present invention, the variation of the characteristics of the recording elements (e.g., the variation of the resistances of the thermal elements) is corrected as follows: first, the recording elements (e.g., thermal elements) included in the recording head are divided into a plurality of blocks; second, the data which are prestored in the memory for providing the driving conditions such as pulse widths are retrieved from the memory; and finally, the recording elements are driven block by block in sequence with appropriate driving energy for each block on the basis of the data. Thus, the variation of the recording elements among different blocks are corrected. As a result, the ink ejection of the ink jet recording method or the thermal recording of the thermal recording method can be stabilized, thereby achieving high quality images.

Furthermore, according to one aspect of the present invention, a plurality of electrothermal transducers (heaters) are divided into blocks each of which is driven by a driver to which an optimum drive index (an energy index) is assigned which is determined according to the average resistance of the electrothermal transducers of the block, and is previously stored in the recording head in the course of the fabrication and inspection process or the like of the recording head. The prestored drive indices are sequentially read through the drivers so that electrothermal transducers are driven by the optimum pulse widths when the blocks are sequentially driven to record images. As a result, the electric energy of appropriate driving conditions is applied to the electrothermal transducers through individual drivers. This will stabilize the recording operation, thereby achieving high quality images.

Thus, since the present invention controls the driving conditions of the recording elements (e.g., the thermal elements) to appropriate values block by block, the variation of the characteristics of the recording elements can be corrected by a rather simple circuit arrangement. This enables the generation of energy used for recording (e.g., the thermal energy used for ejecting the ink) to be stabilized. As a result, ejection of uniform droplets of ink can be carried out without increasing the size of the apparatus, high quality recording of images can be achieved, and the life of the recording head is lengthened.

The above and other objects, effects, features and advantages of the present invention will become more apparent from the following description of the embodiments thereof taken in conjunction with the accompanying drawings.

BRIEF DESCRIPTION OF THE DRAWINGS

FIG. 11 is a view showing an example of the relationship between the binary number of the drive index set as shown in FIG. 10B and the pulse widths applied to the drivers;

DETAILED DESCRIPTION OF THE PREFERRED EMBODIMENTS

The invention will now be described with reference to the accompanying drawings.

Figure 1:
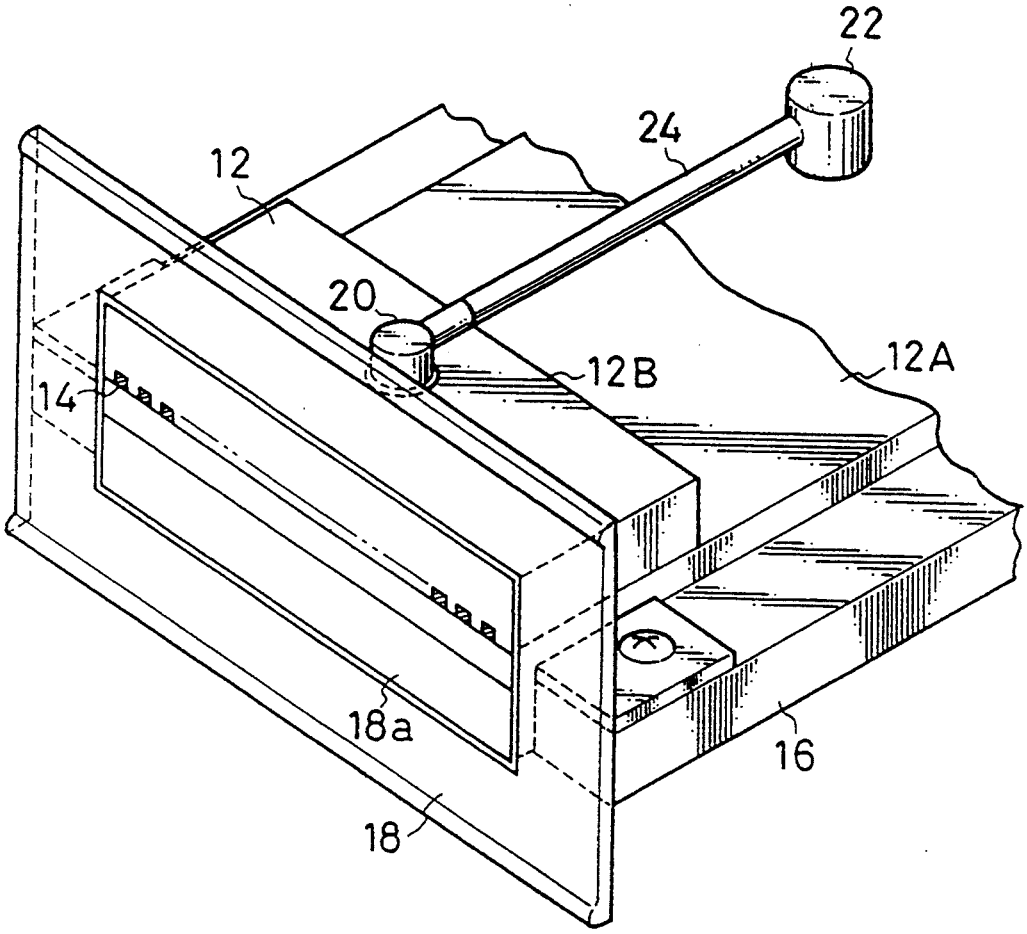
FIG. 1 PRIOR ART
FIG. 1 is a schematic perspective view showing an example of a recording head used by an ink jet recording apparatus in accordance with the present invention.

FIG. 1 shows an example of a recording head used by the ink jet recording apparatus to which the present invention is applied.

Referring to FIG. 1, an ejection element 12 includes liquid passages, ink ejection outlets 14, and a common ink chamber. The liquid passages contain devices such as thermal elements (thermal energy generating means) which are disposed in parallel in the liquid passages, respectively, and produce thermal energy used for ejecting ink. The ejection outlets 14 are arranged at front ends of the liquid passages. The common ink chamber supplies the liquid passages with ink stored therein. The ink is ejected from the ejection outlets 14 in the form of ink droplets for recording images. The ejection element 12 is constructed by joining a substrate 12A and a top plate 12B together. Here, the substrate (a heater board) 12A has thermal elements and wiring arranged thereon, and the top plate 12B has grooves for forming the liquid passages and the common ink chamber.

The substrate 12A is attached to a base plate 16 by adhesion or the like. On the front of the ejection element 12 and the base plate 16, a front plate 18 is fixed by fastening members such as bolts. The front plate 18 has an opening 18*a* through which the ejection outlets 14 directly face a recording medium. Portions 20, 22 and 24 are members constituting a part of an ink supply system. Member 20 is an elbow-shaped connecting member for guiding ink into the common ink chamber. Member 22 is a filter unit disposed in the ink supply passage from an ink reservoir as an ink supply source. Member 24 is a supply pipe coupling the connecting member 20 and the filter unit 22.

Figure 2:
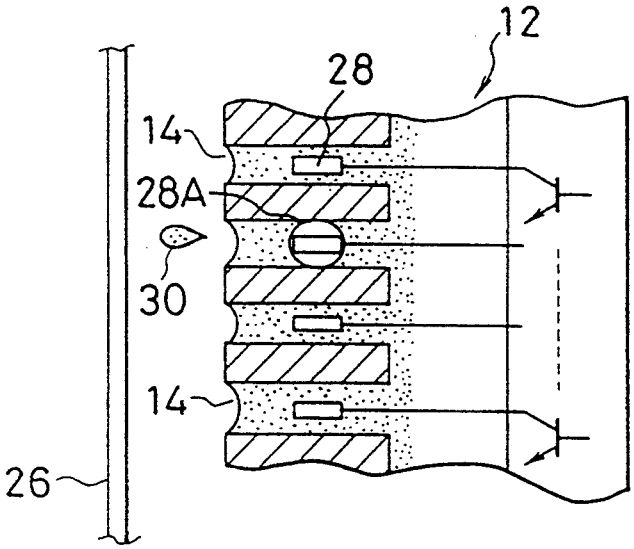
FIG. 2 PRIOR ART
FIG. 2 is a schematic horizontal sectional view illustrating the principle of ink ejection of the recording head.

FIG. 2 is a schematic horizontal sectional view showing a part of the ink ejection portion of the recording head. In FIG. 2, on the surface of the ejection element 12 facing a recording medium 26, are arranged a plurality of the ink ejection outlets 14 spaced a certain pitch apart. The ink ejection outlets 14 communicate to the ink passages in which electrothermal transducers 28 are disposed. The electrothermal transducers 28 generate bubbles 28A in the ink when they are driven (heated by currents) according to dot information. The bubbles 28A change the pressure in the ink, thereby forming projected ink droplets 30 which adhere to the recording medium 26 in certain patterns to form images. Incidentally, the heater board 12A may integrally include drivers for driving the electrothermal transducers 28.

Figure 3:
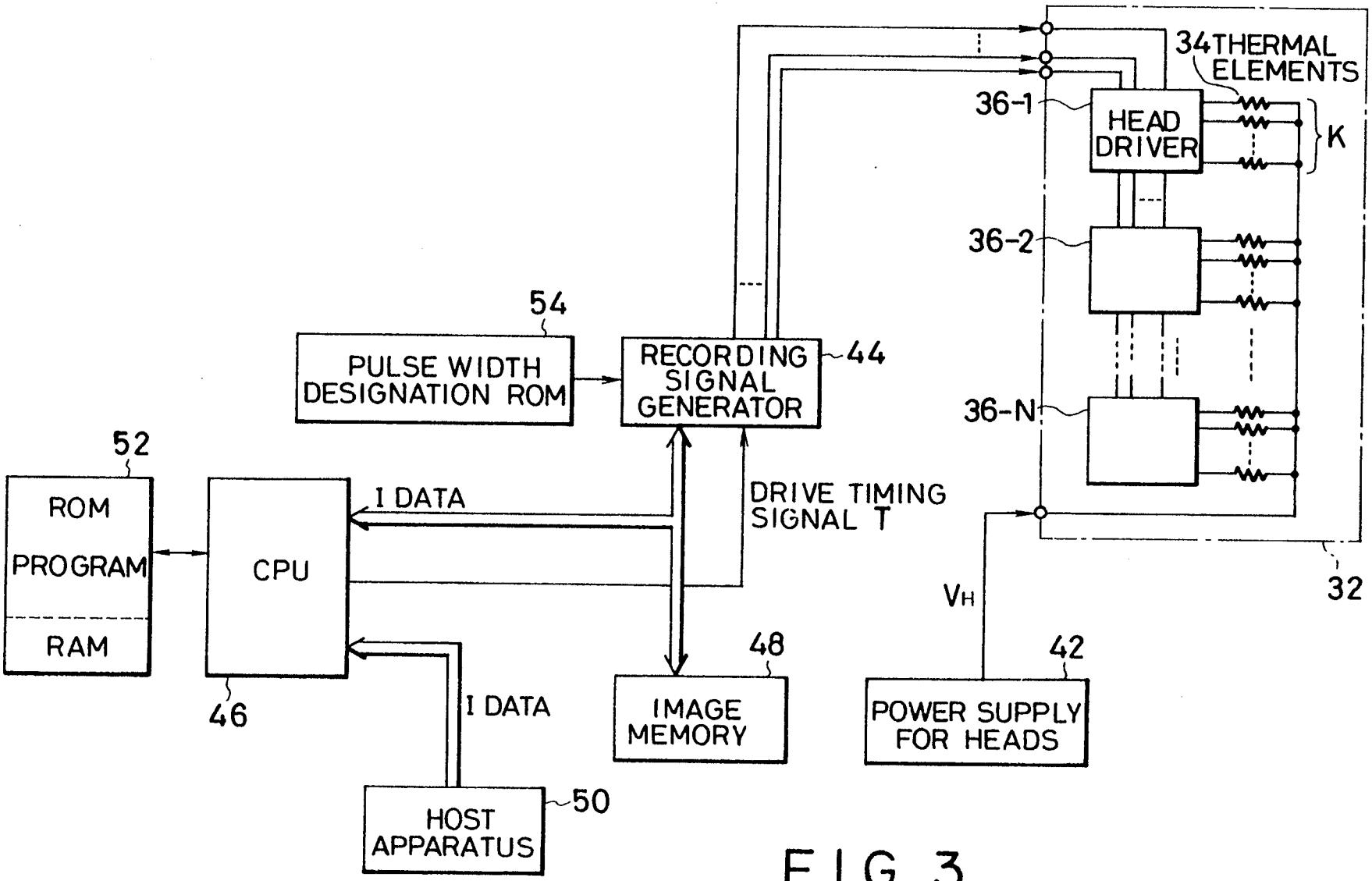
FIG. 3 is a block diagram showing a first embodiment of an ink jet recording apparatus in accordance with the present invention.

FIG. 3 is a block diagram showing an embodiment of an ink jet recording apparatus to which the present invention is applied. In FIG. 3, reference numeral 32 designates the recording head described with reference to FIGS. 1 and 2. The recording head 32 has a plurality of ink ejection outlets aligned in a certain direction: for example, they are aligned over the full length across the recording medium 26. The recording head 32 contains thermal elements 34 disposed in the liquid passages communicating to the respective ink ejection outlets. The thermal elements 34 are divided into a plurality of (=N) blocks each of which includes a predetermined number of (=K) thermal elements (and ink ejection outlets), and the thermal elements belonging to the same block are simultaneously driven by one of the head drivers 36-1-36-N each of which is made as an IC circuit.

Figure 4:
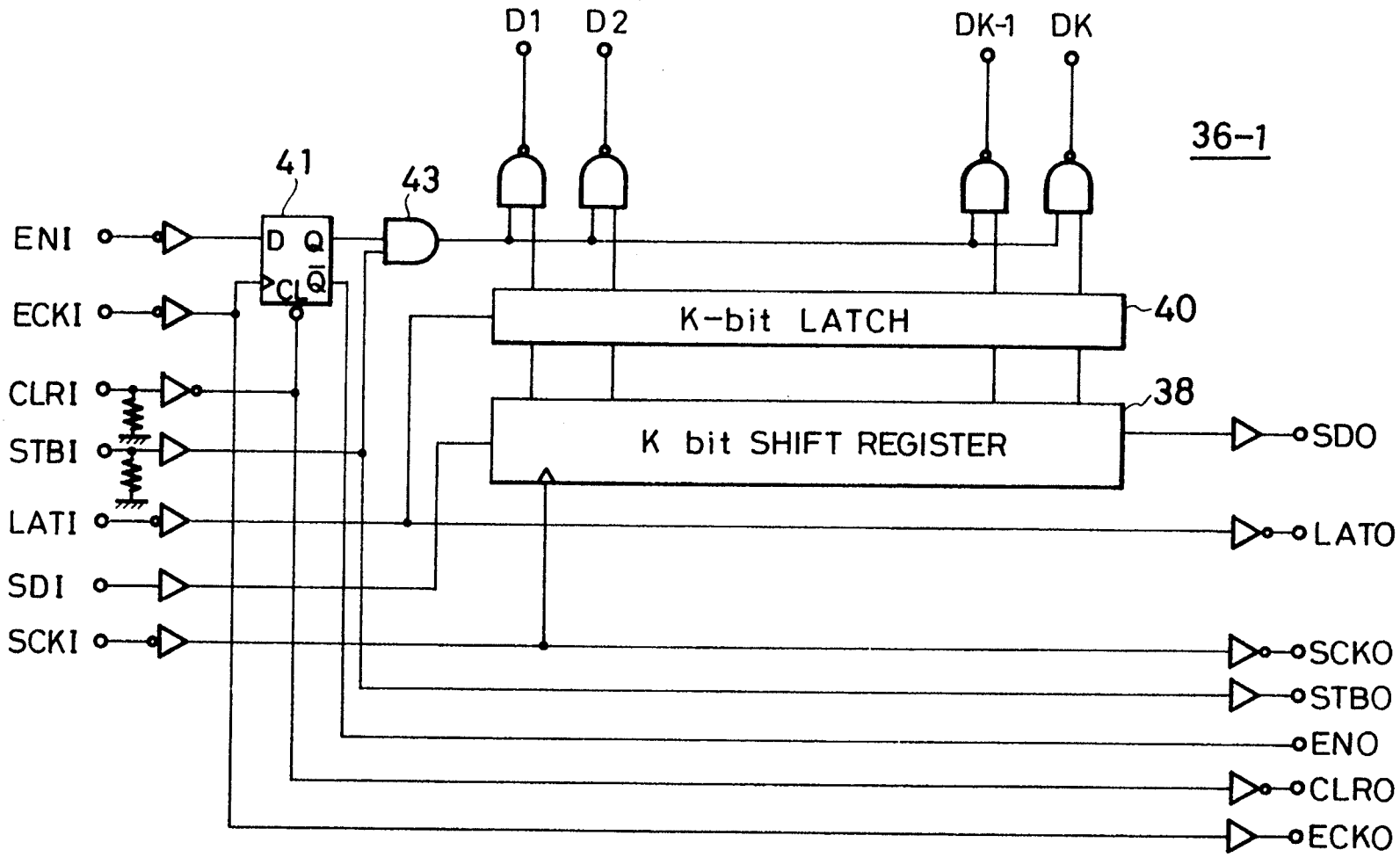
FIG. 4 is a circuit diagram showing an example of the head driver shown in FIG. 3.

As shown in FIG. 4, each of the head drivers 36-1-36-N has a K-bit shift register 38 and a K-bit latch 40. The shift register 38 stores a part of a 1-line data signal SD in such a manner that each bit of the shift register corresponds to each respective one of the K (=64, for example) thermal elements of the block. The latch 40 latches the bit data in the shift register 38 in response to a latch signal LAT. Furthermore, each of the head drivers 36-1-36-N includes a flip-flop, inverters, and gate circuits as switching means for driving respective thermal elements 34 in response to a strobe signal STB, an enable input signal EN, an enable clock signal ECK and the like. Other reference characters in FIG. 4 are as follows: D1 - DK designate terminals connected to the thermal elements 34 forming the block; SCK denotes a clock signal for transferring the recording data; and CLR designates a clear signal of the flip-flops. A suffix "O" attached to signals SDO - ECKO at the right-hand side of FIG. 4, indicates that these signals are outputted to the next driver.

A signal SDO is fed to the next head driver as a data signal SDI. A signal LATO is fed to the next head driver as a latch signal LATI. A signal STBO is fed to the next head driver as a strobe signal STBI. A signal SCKO is fed to the next head driver as a data transfer clock SCKI. A signal ENO is fed to the next head driver as an enable input signal ENI. A signal CLRO is fed to the next head driver as a clear signal CLRI. A signal ECKO is fed to the next head driver as an enable clock signal ECKI.

Referring to FIG. 3 again, the thermal elements 34 in the recording head 32 are provided with a drive voltage VH from a power supply 42. On the other hand, the head drivers 36-1-36-N are provided with signals from a recording signal generator 44 that generates the signals in response to a drive timing signal T from a CPU 46. The CPU 46 accepts image data IDATA from a host apparatus 50 functioning as the source of the image data, and transfers the image data IDATA to an image memory 48 . The CPU 4 6 is connected to an ROM 52 that stores various programs executed by the CPU, and to an RAM used as working areas . The recording signal generator 44 is connected to a pulse width designation ROM 54 which stores data that designate the pulse widths of respective head drivers 36-1-36-N. The data are predetermined in accordance with the characteristics of thermal elements 34 so that individual head drivers 36-1-36-N can carry out the optimum drive of the thermal elements 34.

The recording signal generator 44 thus arranged operate as follows: first, it reads out the image data IDATA stored in the image memory 48 in response to the drive timing signal T from the CPU 46; second, it generates the data signal SI together with clock signals and the latch signal LAT; and at the same time, it sequentially reads out the optimum pulse widths to drive the respective head drivers 36-1-36-N from the pulse width designation memory 54, and sequentially supplies the head drivers with strobe signals STB of the optimum pulse widths for individual head drivers.

Figure 5:
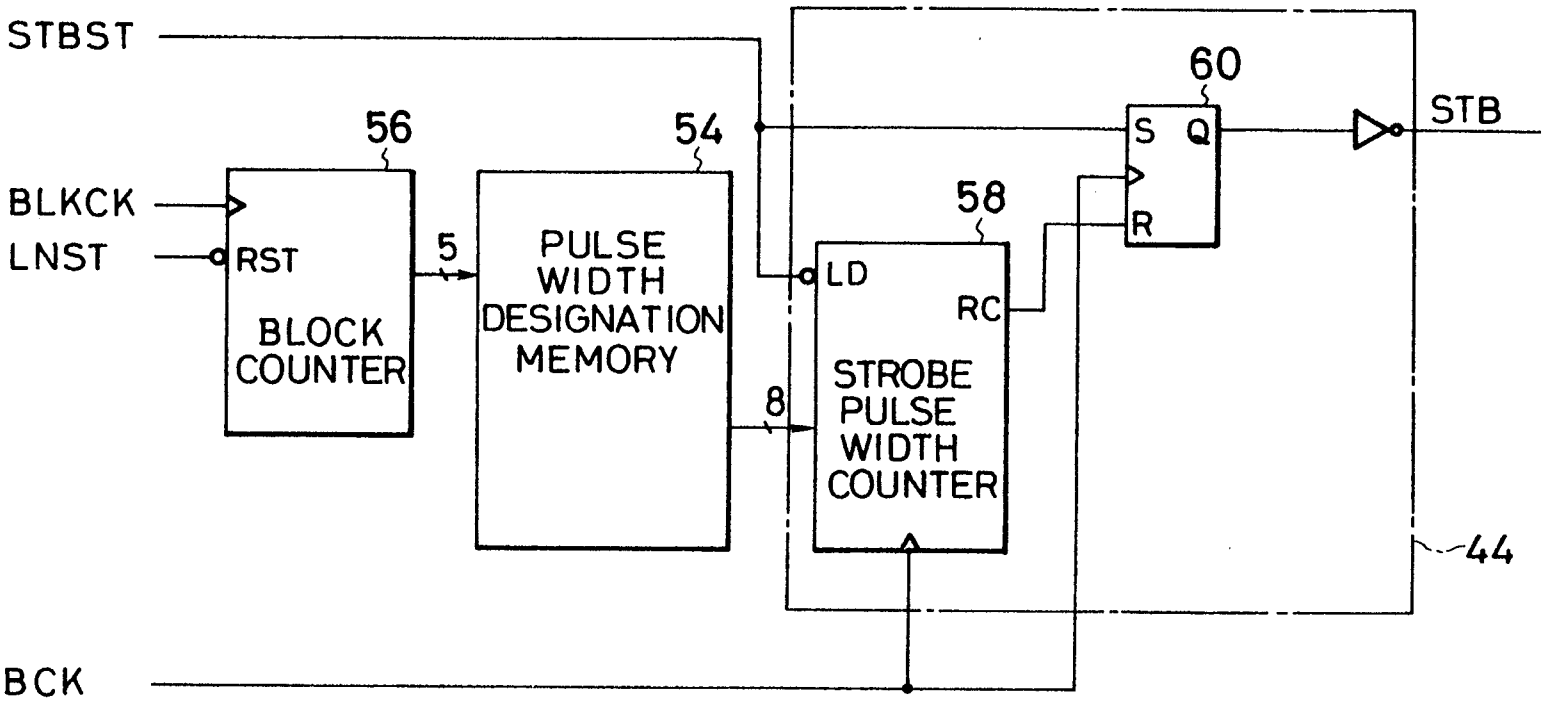
FIG. 5 is a block diagram showing the details of the recording signal generator and the pulse width designation memory shown in FIG. 3.
Figure 6:
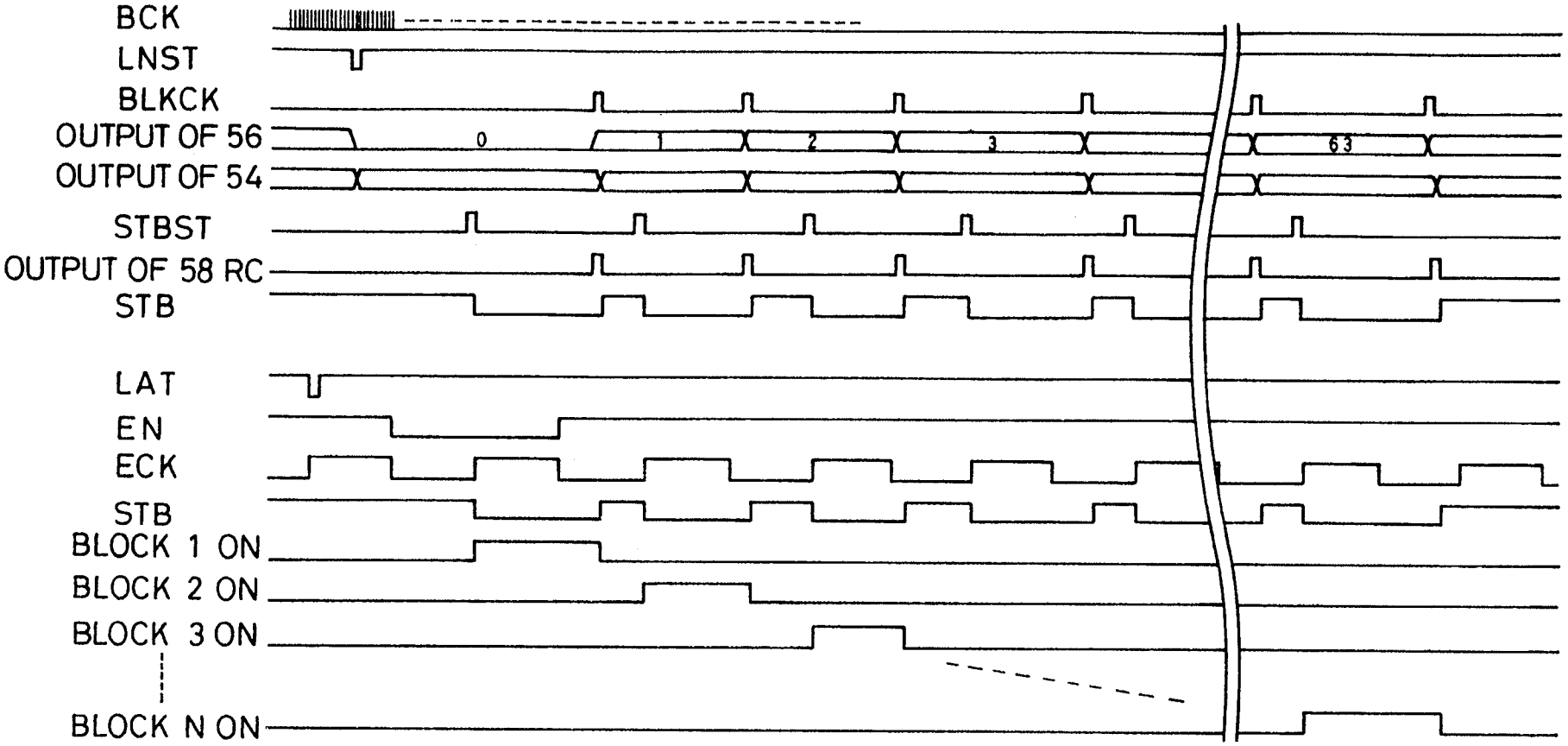
FIG. 6 is a diagram showing the operation of the recording signal generator and the timing of the head drive signal shown in FIG. 3.

FIG. 5 shows an arrangement of circuits involved in generating the strobe signal STB, including the recording signal generator 44 and the pulse width designation memory 54, and FIG. 6 illustrates the timing of the signals generated by the circuits.

In FIG. 5, the pulse width designation memory 54 is connected to a block counter 56 which is reset by a line start signal LNST generated for each line, and counts up block clocks BLKCK generated each time each respective one of the blocks is driven. The output of the block counter 56 (5 bits) is applied to the address terminal of the pulse width designation memory 54 each time the counter counts up, and the content of the address, that is, the pulse width data (8 bits) is read out. The pulse width data produced from the pulse width designation memory 54 is fed to a strobe pulse width counter 58 as preset data to be set into the counter by the strobe start signal STBST. The strobe pulse width counter 58 produces a ripple carry signal RC when it counts the basic clock BCK a certain number of times determined by the preset data. The signal RC is fed to a strobe flip-flop 60 to reset the flip-flop which has been set by the strobe start signal STBST.

One line of image data that is read from the image memory 48, is transmitted to the shift register 38 in the head drivers 36-1–36-N in synchronism with the data transfer clock SCKI, and is latched into the latch 40 by the latch signal LAT with a predetermined timing. After that, the line data are outputted every time a line start signal LNST (see, FIG. 5) is issued. The flip-flop 41 is set by the enable clock signal ECKI when the enable input signal ENI is applied to the head driver 36-1, and the output of the flip-flop is applied to an input of a first input of an AND gate 43.

On the other hand, in FIG. 5, the block counter 56 is reset by the line start signal LNST. By this, pulse width data corresponding to the head driver 36-1 is read from the pulse width designation memory 54, and is preset into the strobe pulse width counter 58 in synchronism with a strobe start signal. In addition, the strobe flip-flop 60 is set by the strobe start signal STBST, thereby producing the strobe signal STB which is applied to a second input of the AND gate 43 as the strobe signal STBI. The strobe signal is being produced until the strobe pulse width counter 58 counts down the block clock BLKCK by the number preset thereto. Accordingly, the drive pulse is being produced from the and gate 43 as long as the strobe signal STBI is present.

Then, the flip-flop 41 is reset by the next enable clock signal ECKI. By this, the flip-flop 41 of the head driver 36-2 is set, and the output of the flip-flop is fed to the first input of the AND gate 43. In FIG. 5, the block clock BLKCK which is produced in response to the termination of the drive of the previous block is applied to the block counter 56 which counts up the clock. As a result, the pulse width data corresponding to the head driver 36-2 is read from the pulse width designation memory 54, and is set to the strobe pulse width counter. Thus, the strobe signal STB corresponding to the pulse width is produced, and the head driver 36-2 is driven during the pulse width. Likewise, the head driver 36-3–36-N are sequentially driven thereafter.

Thus, the strobe flip-flop 60 produces a strobe signal STB composed of a series of pulses each having the pulse width determined by the flip-flop 60. These pulses are sequentially applied to the head drivers 36–36-N (or the blocks 1 - N) so that each head driver can drive the thermal elements in the block with the optimum pulse width as shown in FIG. 6.

Figure 7:
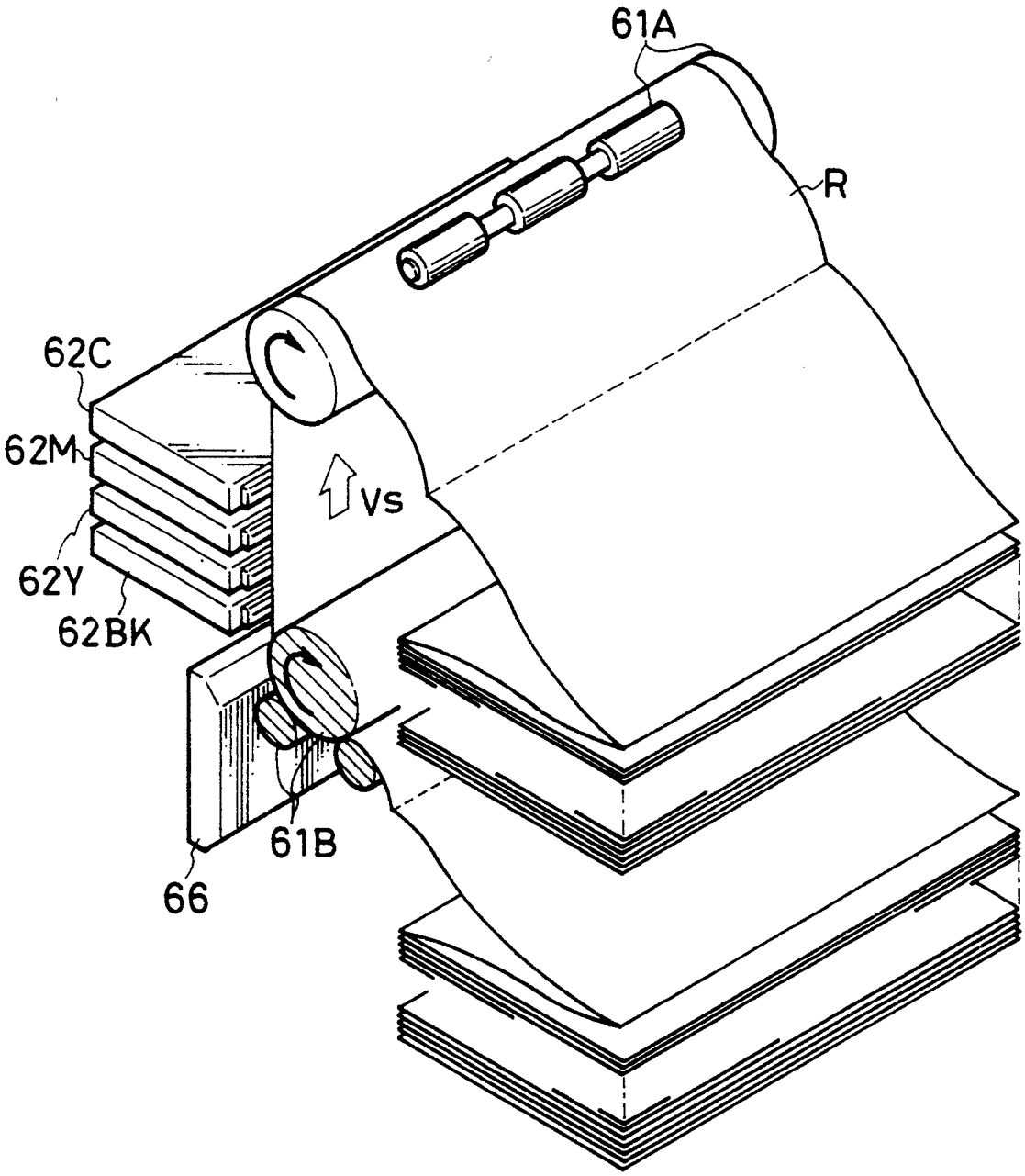
FIG. 7 is a perspective view showing a second example of the mechanical structure of the ink jet recording apparatus in accordance with the present invention.

Using the recording head and its drive system described above makes it possible to arrange a full-color line printer as shown in FIG. 7.

In FIG. 7, reference numerals 61A and 61B designate two pairs of rollers provided for holding and transferring a recording medium R (shown as fanfold paper in this figure) in the subscanning direction Vs. Four recording heads 62BK, 62Y, 62M and 62C for recording black, yellow, magenta, and cyan, respectively, are disposed in this sequence from the upstream of the transferring direction of the recording medium, thus constituting a full-multitype recording head. All these recording heads have ink ejection outlets extending over the full length across the recording medium R.

Below the recording head 62BK, is provided a recovery system 66 which replaces the recording medium R so as to face the recording heads 62BK–62C when the ejection recovery processing is performed. The frequency of executing the ejection recovery processing can be remarkably reduced in this embodiment because preliminary heating is performed at appropriate timings.

Figure 8:
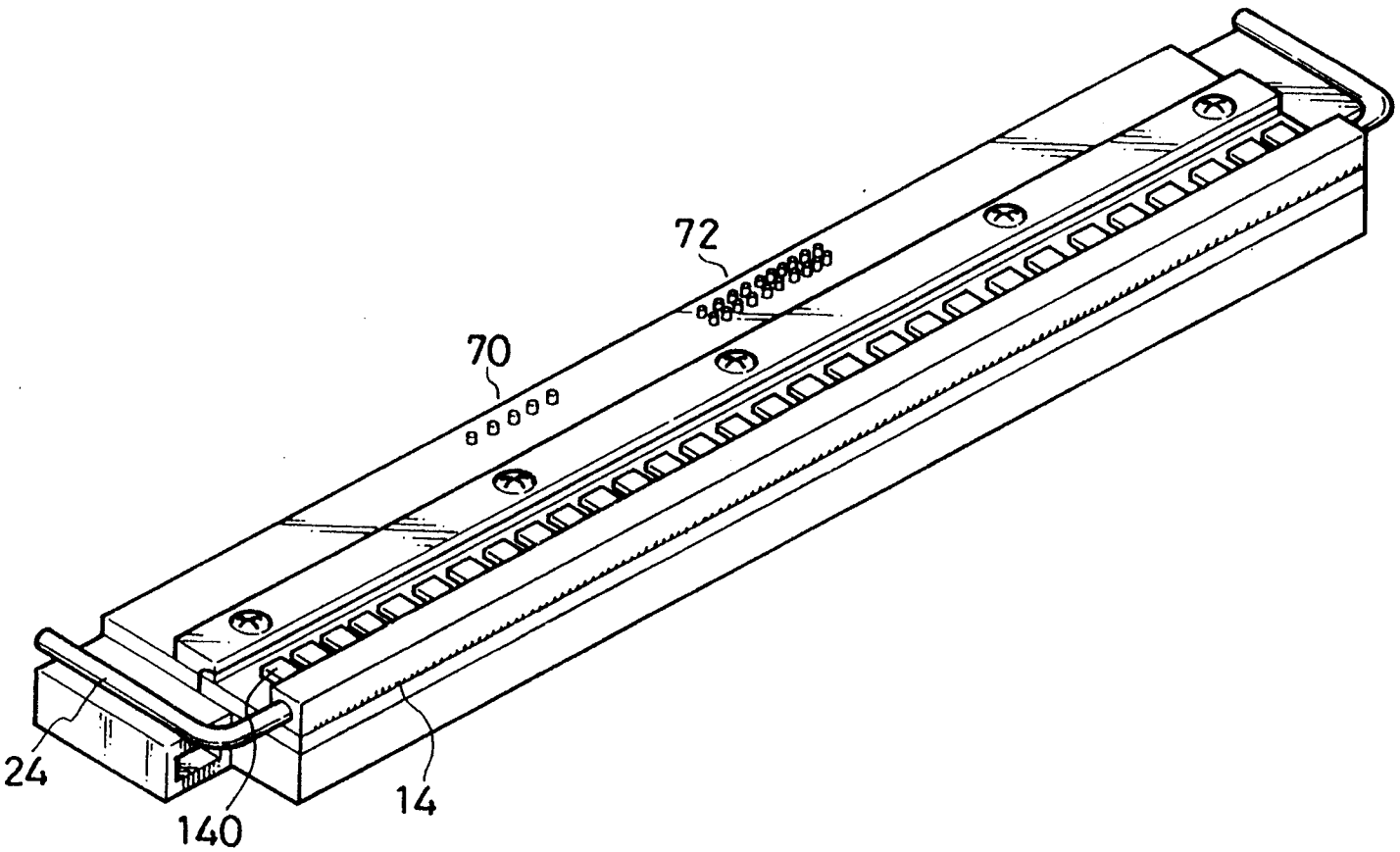
FIG. 8 is a perspective view showing the appearance of the ink jet recording head shown in FIG. 7.

FIG. 8 shows the appearance of the recording heads 62BK–62C of FIG. 7. In FIG. 8, reference numeral 14 designates ink ejection outlets, 24, an ink supply pipe, 140, a plurality of IC circuits (drivers) for driving the electrothermal transducers of the present invention, and 70 and 72, terminals.

SECOND EMBODIMENT

Figure 9A:
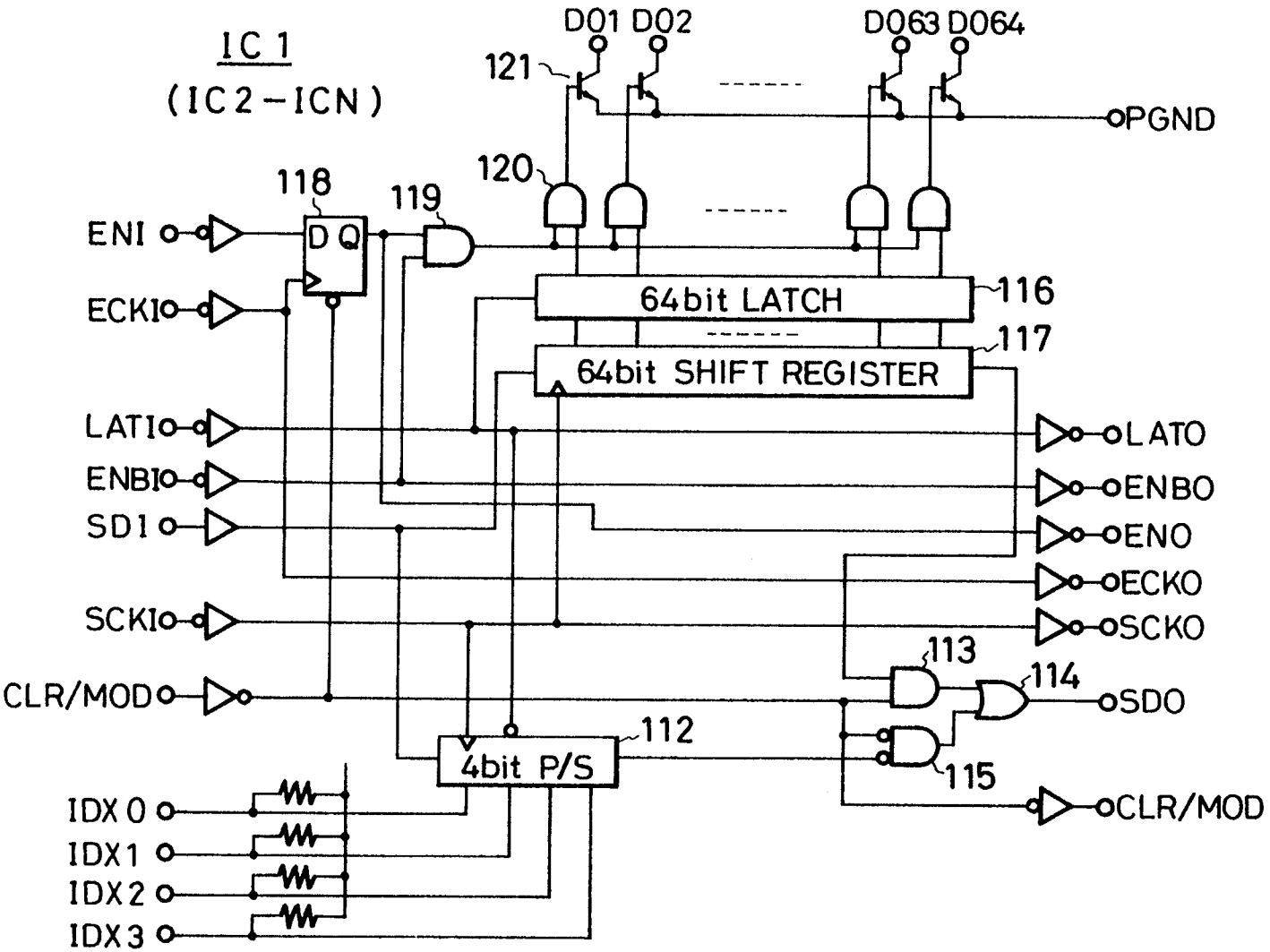
FIG. 9A is a circuit diagram showing the circuit arrangement of the driver (IC) of electrothermal transducer elements in accordance with the second embodiment of the present invent ion.
Figure 9B:
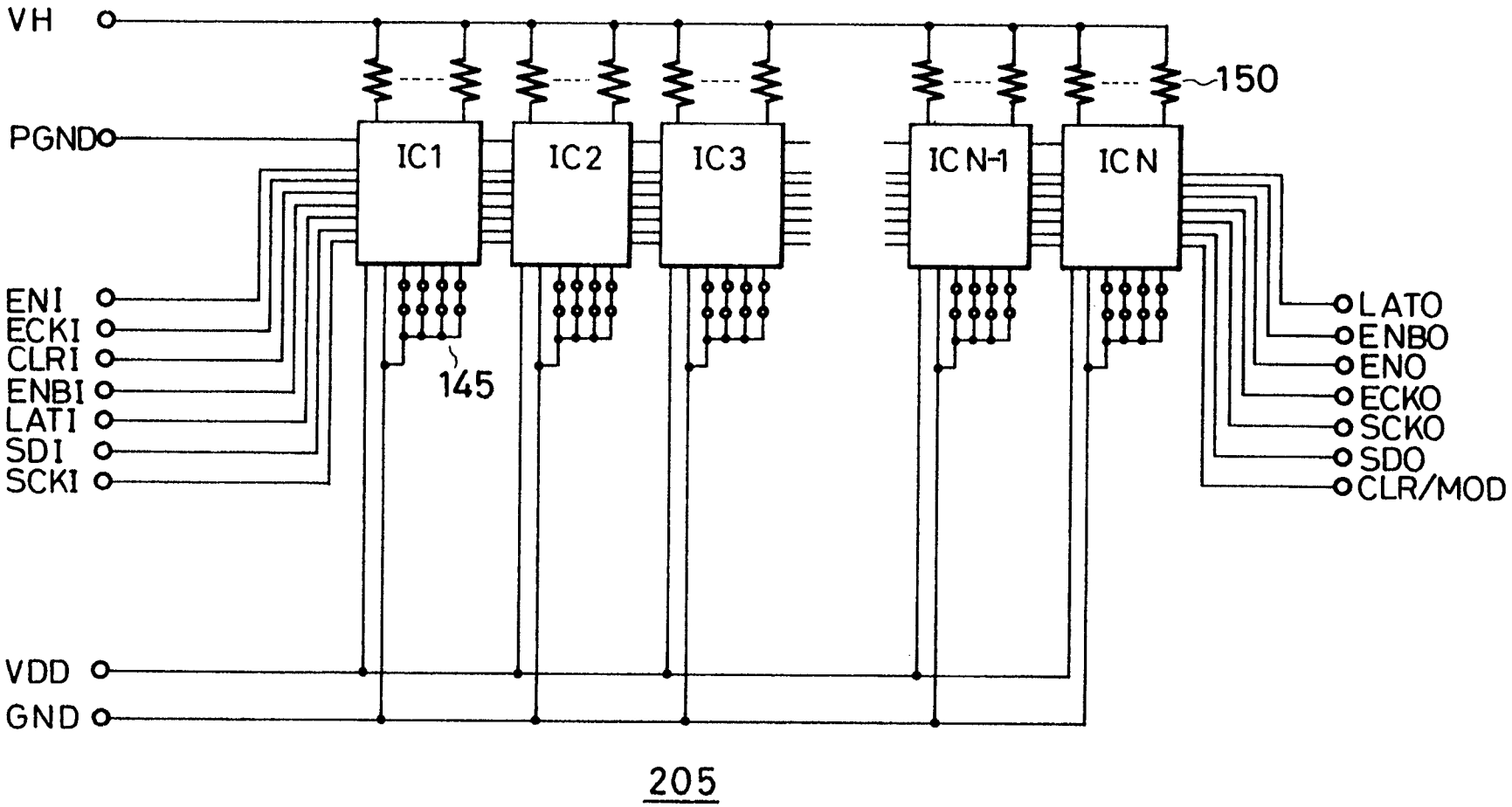
FIG. 9B is a circuit diagram showing the circuit arrangement of the recording head of the second embodiment of the present invention which uses a plurality of drivers shown in FIG. 9A.
Figure 9C:
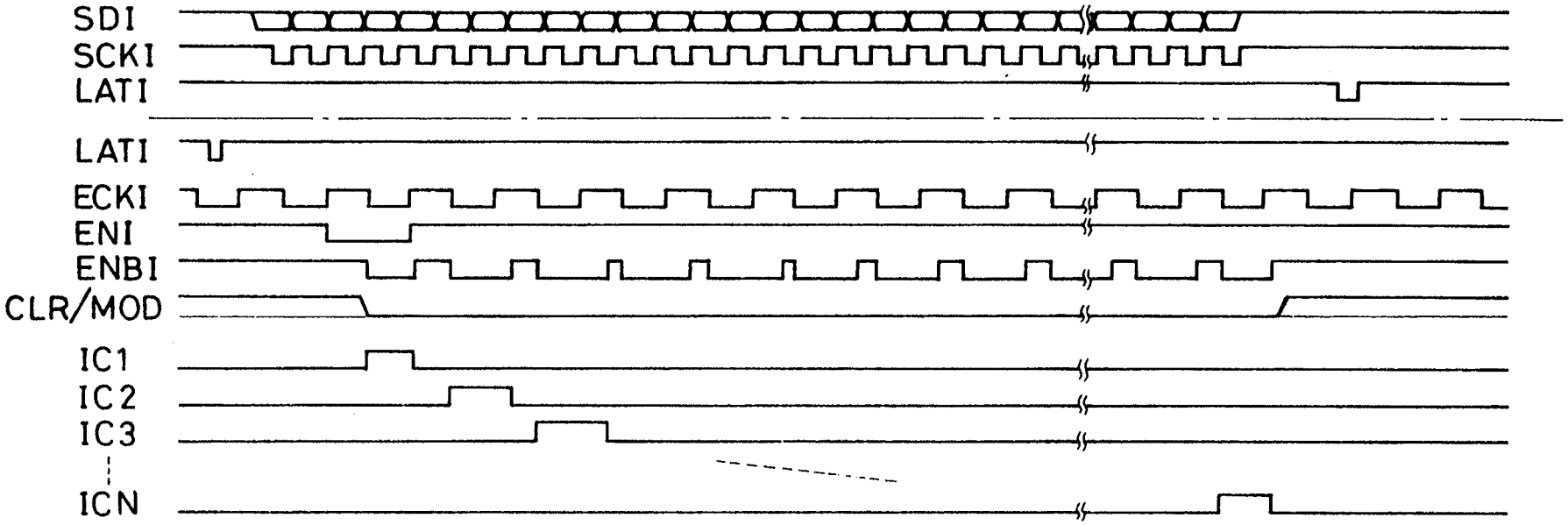
FIG. 9C is a timing diagram showing the normal drive timing of the recording head of FIG. 9B.
Figure 9D:
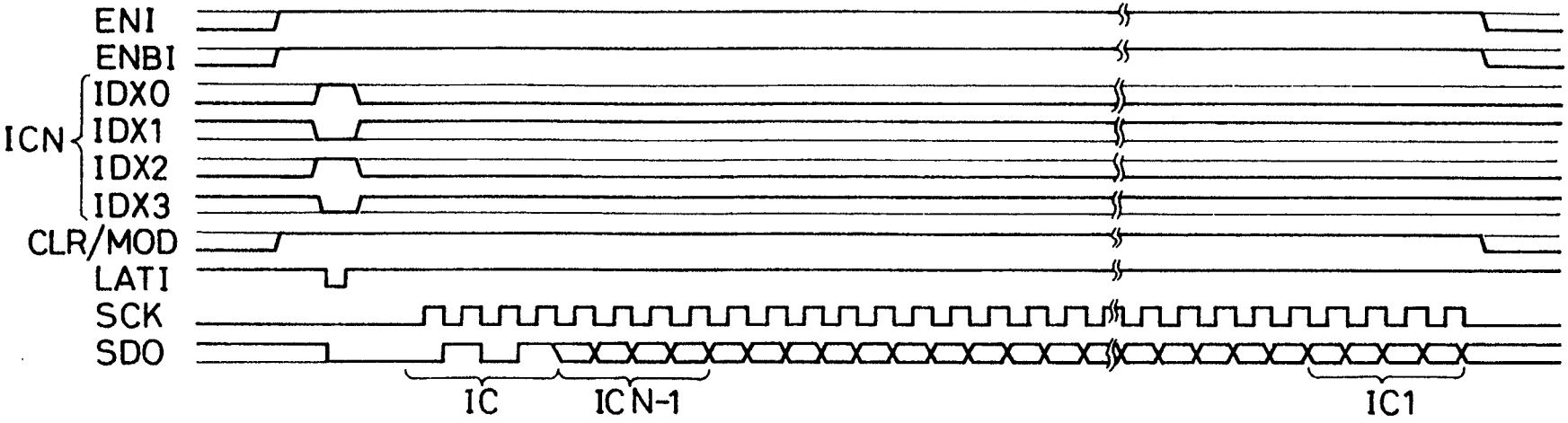
FIG. 9D is a timing diagram showing the drive timing of the recording head shown in FIG. 9B in the case where drive indices are read.

FIGS. 9A and 9B show an arrangement of the driver of the recording head of the second embodiment of the present invention, and FIGS. 9C and 9D illustrate the timing of the operation of the drivers. FIG. 9A shows a circuit configuration of each driver arranged into an IC. In FIG. 9A, reference characters IDX0–IDX3 denote respective digits of a drive index signal fed from a drive index setting portion 145 in FIG. 9B. Reference character CLR/MOD designates a clear/mode signal for inhibiting the ejection of ink during the transfer of the drive index signal which is sent to a drive index read and designation portion 204 in FIG. 12.

Reference numeral 112 denotes a shift register functioning as a 4-bit parallel-to-serial (P/S) converter which reads the respective bits IDX0–IDX3 of the drive index signal that have been previously set in the drive index setting portion 145 in FIG. 9B, and which transfers the bits in synchronism with a shift clock SCK1 . Reference character LAT1 denotes a load signal for loading the bits IDX0–IDX3 of the drive index signal into the parallel-to-serial converter 112. This signal LAT1 is also used as a latch signal for loading recording data from a shift register 117 to a latch 116 in a normal drive mode which will be described later. Reference numerals 113–115 designate gate circuits for switching serial data between the drive index input mode, in which the drive index signal is transmitted from the serial-to-parallel converter 112 to the drive index read and designation portion 204 in FIG. 12, and the normal drive mode, in which the recording data is loaded into the shift registers 117 of respective drivers, and then the electrothermal elements are driven block by block by the drivers.

FIG. 9B shows the entire arrangement of a recording head unit 205 (see FIG. 12) of the second embodiment of the present invention. In FIG. 9B, reference characters IC1–ICN designate the drivers each of which is arranged as shown in FIG. 9A, and is integrated into an IC. Patterns depicted at the bottom of the drivers IC-1–ICN in FIG. 9B are driver index setting portions 145, and parts depicted on the top of the drivers IC1–ICN are electrothermal transducers (thermal elements) 150 as energy producing members provided in the ink ejection outlets.

The drive index setting portions 145 are formed in the course of fabrication process of the recording head as follows: first, the resistances of the thermal elements in one block are measured; second, the average value of the resistances are calculated; third, the optimum value of the drive index of the block is determined according to the average value of the resistances; and fourth, the preformed pattern of the drive index setting portion 145 (see FIG. 10A) is selectively cut off by a laser beam or the like so that the optimum value is set as the drive index of the block (see FIG. 10B). This procedure is repeated for all the blocks to set the drive indices of all the drivers IC1–ICN in FIG. 9B. An example of the patterns set in the process above is shown in FIG. 11.

Each pattern is represented by a binary word that indicates the amount of increase or the amount of decrease from the standard pulse width. Thus, a recording head is fabricated in which the optimum drive indices are set for respective blocks, i . e. , for respective IC1–ICN.

Figure 10A:
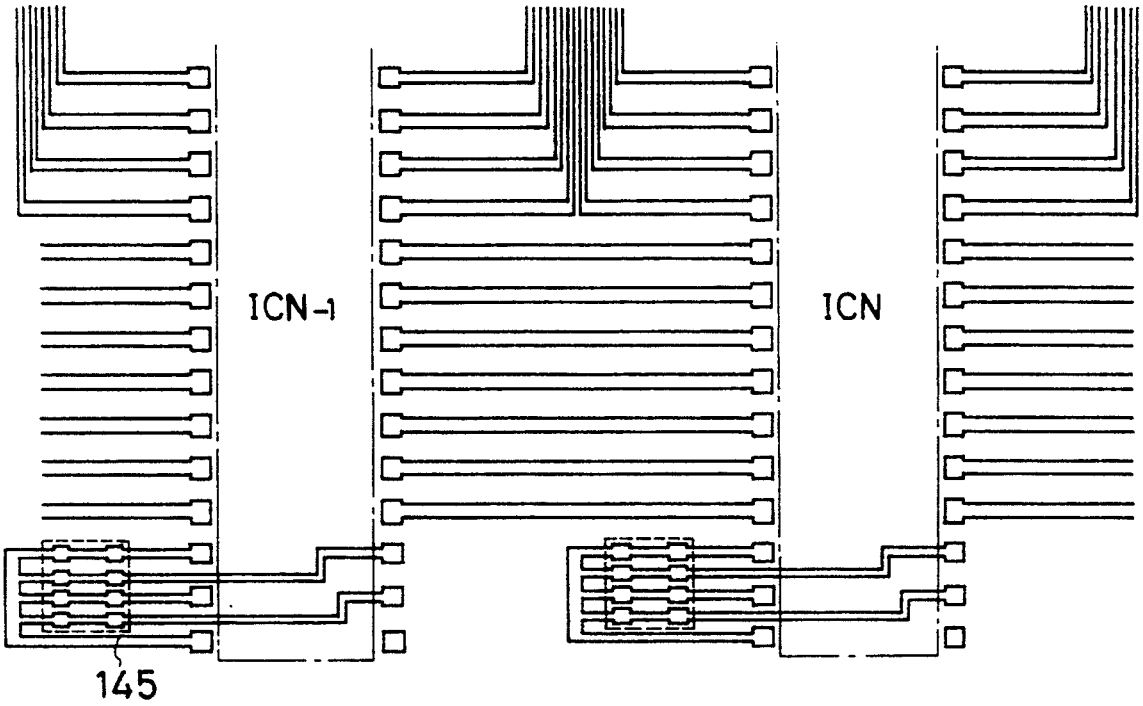
FIG. 10A is a plan view showing packaging patterns of the driver circuit shown in FIG. 9B arranged on the recording head substrate.
Figure 10B:
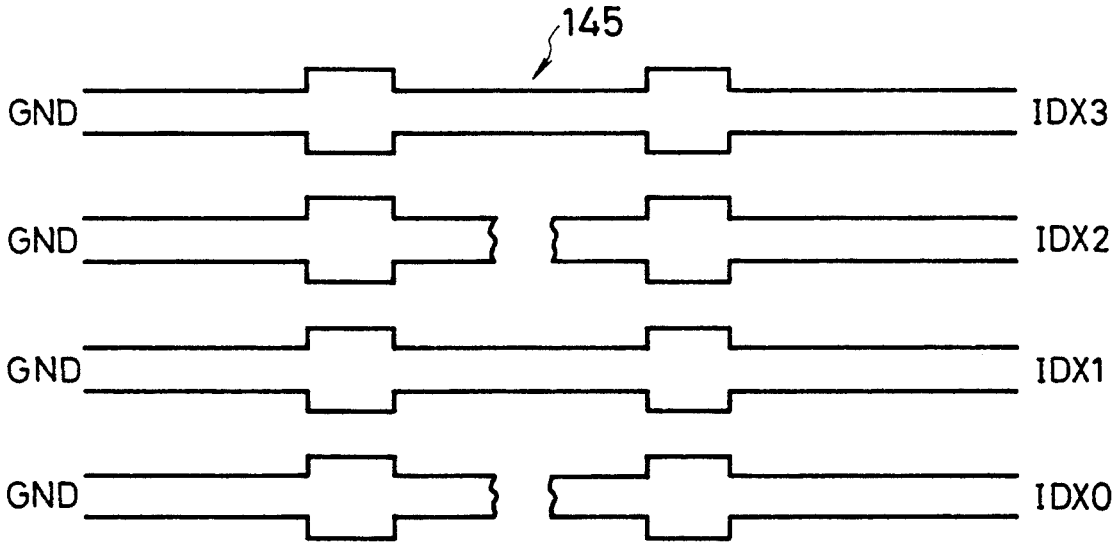
FIG. 10B is a plan view showing an example of a drive index setting portion which is enclosed by broken line rectangles shown in FIG. 10A, and in which the patterns are cut for setting the drive index.

FIGS. 10A and 10B show the packaging pattern of the driver ICs on the recording head substrate. FIG. 10A shows the drive index setting portion 145 enclosed by broken line rectangles. FIG. 10B shows an example in which parts of the setting pattern are cut off.

Figure 12:
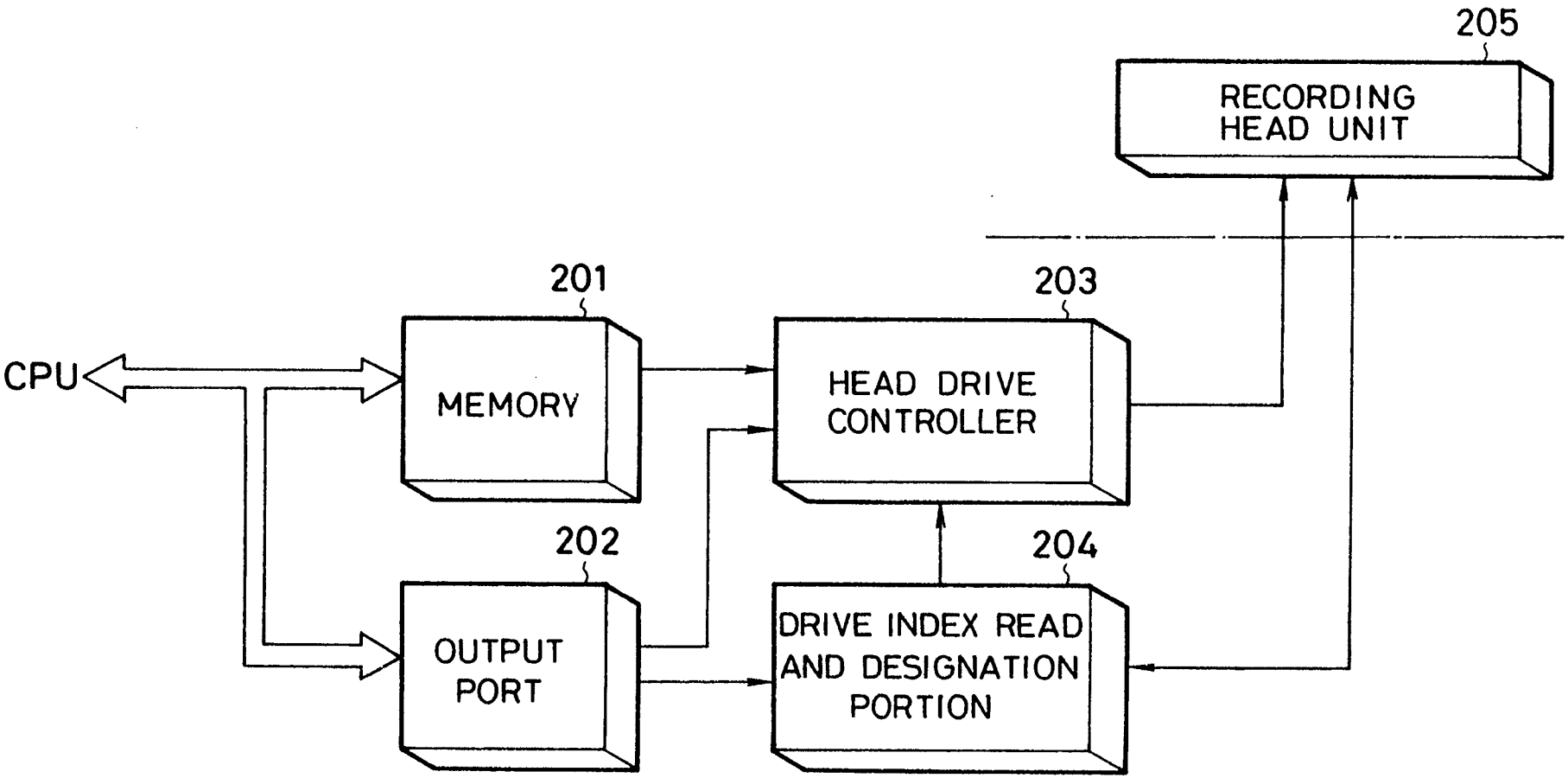
FIG. 12 is a block diagram showing an example of a circuit arrangement of the driver system of the recording head unit of the embodiment shown in FIG. 9B.

FIG. 12 shows a block diagram of the control system of the main body that controls the recording head of the second embodiment of the present invention. The control system operates in two modes: the drive index input mode in which the drive index signal is transmitted from the parallel-to-serial converter 112 in FIG. 9A to the drive index read and designation portion 204 in FIG. 12; and the normal drive mode in which the recording data is loaded into the shift registers 117 of respective drivers, and then the electrothermal transducers 150 are driven block by block by the drivers.

First, the operation of the drive index input mode is described. In this mode, the CLR/MOD signal rises to the high level with a predetermined timing, e.g., in synchronism with the power on, thereby the ink ejection is inhibited. Then, the drive index signal IDX-0–IDX3 is loaded into the parallel-to-serial converter 112 by the latch signal LAT1. The drive index signal is read from the parallel-to-serial converter 112 in a serial fashion in synchronism with the data transfer clock SCKI, and is transmitted to the next parallel-to-serial converter 112 through the gates 115 and 114. In this case, the drive index signal of the next driver is transferred to the driver following the next driver at the same time. The drive index signal of the blocks 1 - N, which is thus transferred in sequence, is transmitted to the drive index read and designation portion 204, and is stored therein. FIG. 9D shows the timing of the operation.

After that, the normal drive mode is started, the operation timing of which is shown in FIG. 9C: the CLR/MOD signal is switched to the low level, thereby enabling the data in the shift register 117 to be transmitted to the next driver via the gates 113 and 114. In this condition, one line of recording data are transferred from the memory 201 to the shift registers 117 of the respective head drivers, and are loaded into the latches 116. Then, the head drivers IC1–ICN are sequentially driven by the drive signals of the optimum pulse widths as in the first embodiment. More specifically, in this mode, the recording head drive controller 203 generates a pulse train including pulses of widths determined by the drive indices, and sends the pulses as the enable signal ENB1 in FIG. 9C. The enable signal ENB1 is applied to AND gates 119 (see FIG. 9A) of all the drivers IC1–ICN. At the same time, the AND gate 119 of each respective one of the drivers IC1–ICN is sequentially opened by the output of a D-flip--flop 118 which functions as a delay circuit . Thus, the enable signal ENB1 of the optimum width for the block is outputted from the AND gate 119 so that the driver transistors 121 are driven by the outputs of AND gates 120. Therefore, the thermal elements of the block are driven by pulses of the same optimum width.

As described above, according to the present invention, electrothermal transducers (thermal elements) of the recording head are divided into a number blocks, and each block is driven by the drive circuit in which the optimum drive index is previously set. When the electrothermal transducers of the block are driven, the width of the drive pulses applied to the electrothermal transducers is determined by the drive index so that the pulse width takes the optimum value. As a result, the electrothermal transducers are supplied with appropriate energy corresponding to the resistances thereof, thereby achieving high quality recorded images.

Furthermore, according to the second embodiment, the drive index preset values can be obtained through the drivers IC1–ICN by adding simple drive index setting circuits 145 to common drivers, which prevents the recording head from being remarkably increased in size. In addition, since the setting values of the drive indices are converted from parallel to serial signal, they can be transmitted by using the conventional drive signal line. This enables the second embodiment to be compactly implemented without adding extra wiring.

VARIOUS ASPECTS OF THE INVENTION

The present invention can be applied not only to the ink jet recording method and apparatus described above, but also to other types of recording methods and apparatuses such as a thermal type.

Although the above embodiments use pulse widths as a drive condition, voltage values, or the combinations of pulse widths and voltage values can be used. Alternatively, changes in pulse waveforms can be used, or changes in the number of pulses may be used in a system using a plurality of drive pulses.

Moreover, although the above embodiments are described as exemplifying an ink jet recording apparatus which uses, as ink ejection energy generating elements, the electrothermal transducers that generate thermal energy for film boiling the ink, devices for generating energy for ink ejection are not restricted to the electrothermal transducers. It is obvious that the present invention can be applied to recording methods and apparatuses in which the recording is performed by a recording head provided with elements for generating ejection energy by applying electric drive signals such as piezoelectric elements.

The present invention, however, is especially effective when applied to the ink jet recording system, and in particular, to such recording heads and recording apparatuses which are provided with means (such as electrothermal transducers or lasers) for generating thermal energy that generate changes in the state of the ink. This is because the above-mentioned apparatus can achieve high-density and high-precision recording, and hence requires the increasing number of electrothermal transducers or the recording elements, which makes the drive system of the present invention more effective.

The present invention is particularly suitable for use in an ink jet recording head having heating elements that produce thermal energy as energy used for ink ejection and recording apparatus using the head. This is because, high density of the picture element, and high resolution of the recording are possible.

The typical structure and the operational principle are preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet . The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Pat. Application Laying-Open No. 123670/1984 wherein a common slit is used as the ejection outlet for a plurality of electrothermal transducers, and to the structure disclosed in Japanese Pat. Application Laying-open No. 138461/1984 wherein an opening for absorbing a pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plurality recording head combined to cover the entire width.

In addition, the present invention is applicable to a serial type recording head wherein the recording head is fixed on the main assembly, to a replaceable chip type recording head which is connected electrically with the main apparatus and can be supplied with ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating elements and means for preliminary ejection, not for the recording operation, which can stabilize the recording operation.

As regards the kinds and the number of the recording heads mounted, a single head corresponding to a single color ink may be equipped, or a plurality of heads corresponding respectively to a plurality of ink materials having different recording color or density may be equipped. The present invention is effectively applicable to an apparatus having at least one of a monochromatic mode solely with a main color such as black and a multi-color mode with different color ink materials or a full-color mode by color mixture. The multi-color or full-color mode may be realized by a single recording head unit having a plurality of heads formed integrally or by a combination of a plurality of recording heads.

Furthermore, in the foregoing embodiment, the ink has been liquid. It may, however, be an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material that is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid a solid material on through holes or recesses formed in a porous sheet as disclosed in Japanese Pat. Application Laying-Open No. 56847/1979 and Japanese Pat. Application Laying-Open No. 71260/1985. The sheet is faced to the electrothermal transducers . The most effective one for the ink materials described above is the film boiling system.

The ink jet recording apparatus may be used as an output means for various types of information processing apparatus such as a work station, personal or host computer, a word processor, a copying apparatus combined with an image reader, a facsimile machine having functions for transmitting and receiving information, or an optical disc apparatus for recording and/or reproducing information into and/or from an optical disc. These apparatus require means for outputting processed information in the form of a hand copy.

Figure 13:
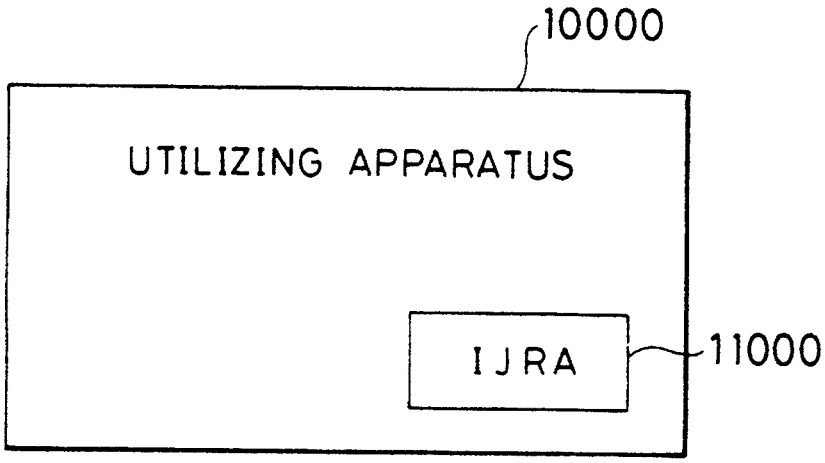
FIG. 13 is a schematic diagram illustrating an embodiment of an apparatus in accordance with the present invention to which the ink jet recording apparatus shown in FIG. 7 is equipped.

FIG. 13 schematically illustrates one embodiment of a utilizing apparatus in accordance with the present invention to which the ink jet recording system shown in FIG. 7 is equipped as an output means for outputting processed information.

In FIG. 13, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 7. The ink jet recording apparatus (IJRA) 11000 receives processed information form the utilizing apparatus 10000 and provides a print output as hand copy under the control of the utilizing apparatus 10000.

Figure 14:
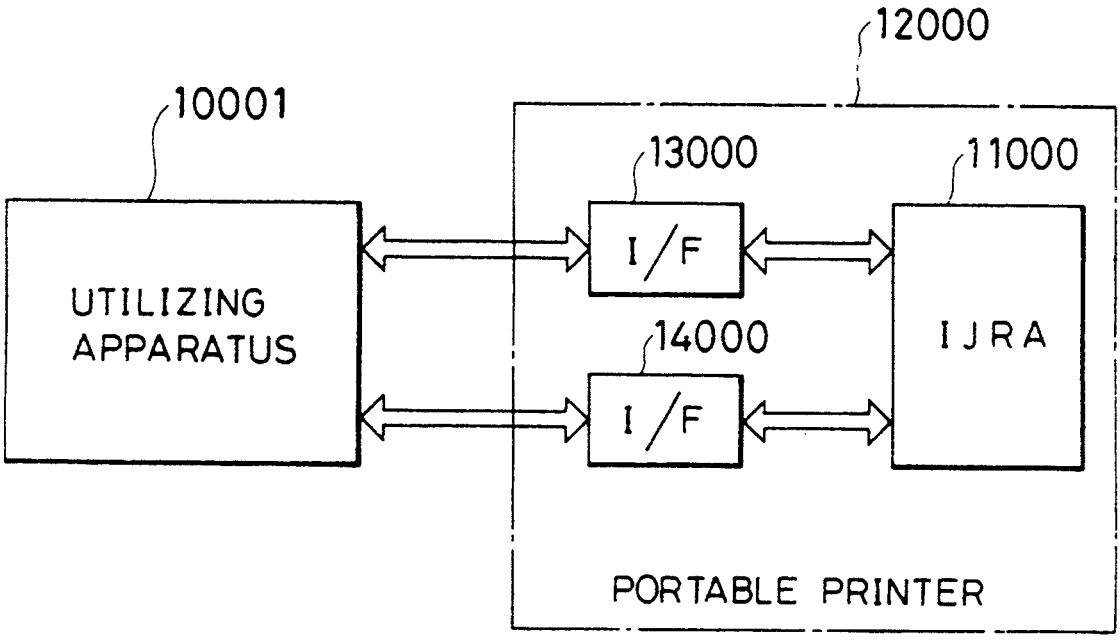
FIG. 14 is a schematic drawing illustrating an embodiment of a portable printer in accordance with the present invention.

FIG. 14 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 14, reference numeral 10001 schematically denotes such a utilizing apparatus. Reference numeral 12000 schematically denotes a portable printer having the ink jet recording apparatus (IJRA) 11000 shown in FIG. 7 which is incorporated thereinto and interface circuits 13000, and 14000, which receive information processed by the utilizing apparatus 11001 and various controlling data for controlling the ink jet recording apparatus 11000, including hand shake and interruption control from the utilizing apparatus 11001. Such control per se is realized by conventional printer control technology.

The invention has been described in detail with respect to the preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A recording method which performs image recording on a recording medium by driving a recording head having a plurality of recording elements, said plurality of recording elements being divided into a plurality of blocks and sequentially driven block by block, said recording elements exhibiting different recording characteristics with respect to a same driving signal due to manufacturing variations, the recording characteristics being related to measurable parameters, said recording method comprising the steps of:

prestoring data for correcting a driving signal for a respective one of said plurality of blocks, the data being determined in accordance with an average of the parameters relating to the recording characteristics of the recording elements in each of said plurality of blocks, the data being common to the recording elements in a same block;

selecting a block from among said plurality of blocks;

outputting data corresponding to said selected block from said prestored data; and simultaneously driving the recording elements in said selected block according to said output data.

2. A recording method as claimed in claim 1, wherein said recording head is an ink jet head which performs recording by ejecting ink, and said plurality of recording elements generate energy used for ejecting said ink.

3. A recording method as claimed in claim 2, wherein said plurality of recording elements generate thermal energy used for ejecting said ink by producing film boiling in said ink.

4. A recording method as claimed in claim 1, wherein said plurality of recording elements comprise electrothermal transducers, and a respective one of the parameters is an electrical resistance value of each of said electro-thermal transducers.

5. A recording apparatus which performs image recording on a recording medium by driving a recording head having a plurality of recording elements, said plurality of recording elements being divided into a plurality of blocks and sequentially driven block by block, said recording elements exhibiting different recording characteristics with respect to a same driving signal due to manufacturing variations, the recording characteristics being related to measurable parameters, said recording apparatus comprising:

storing means for prestoring data for correcting a driving signal for a respective one of said plurality of blocks, the data being determined in accordance with an average of the parameters relating to the recording characteristics of the recording elements in each of said plurality of blocks, the data being common to the recording elements in a same block;

selecting means for selecting a block from among said plurality of blocks;

data output means for outputting data corresponding to said selected block from said storing means; and driving means for simultaneously driving the recording elements in said selected block according to said data output by said data output means.

6. A recording apparatus as claimed in claim 5, wherein said recording head is an ink jet head which performs recording by ejecting ink, and said plurality of recording elements generate energy used for ejecting said ink.

7. A recording apparatus as claimed in claim 6, wherein said plurality of recording elements generate thermal energy used for ejecting said ink by producing film boiling in said ink.

8. A recording apparatus as claimed in claim 5, wherein said plurality of recording elements comprise electro-thermal transducers, and a respective one of the parameters is an electrical resistance value of each of the electro-thermal transducers.

9. A recording apparatus operable in image and non-image recording mode, said apparatus comprising:

recording means having a plurality of recording elements for performing image recording on a recording medium according to image data, said recording elements being divided into a plurality of blocks;

driving means for driving said plurality of recording elements sequentially block by block;

transmission means for transmitting image data to said plurality of recording elements;

storing means for prestoring data on a drive condition for a respective one of said plurality of blocks, wherein said plurality of recording elements and said storing means are arranged on a single substrate plate;

decision means communicating with said transmission means for determining a common drive condition via said plurality of recording elements in said block according to the data transmitted from said storing means through said transmission means during a non-image recording mode, wherein during an image recording mode, said driving means drives the recording elements in a same block in accordance with the common drive condition determined by said decision means.

10. A recording apparatus as claimed in claim 9, wherein the plurality of recording elements are characterized by an average resistance and said data representing a drive condition is an index of energy which is set according to the average resistance of the plurality of recording elements of each block, the average resistance being obtained on the basis of measured data, and said plurality of recording elements of each said block are driven with drive pulses of a pulse width corresponding to said index of energy.

11. A recording apparatus as claimed in claim 9, wherein said recording means is a recording head which is an ink jet which performs image recording by ejecting ink, and wherein said plurality of recording elements generate energy used for ejecting said ink.

12. A recording apparatus as claimed in claim 11, wherein said plurality of recording elements are a plurality of electrothermal transducers which generate thermal energy used for ejecting said ink by producing film boiling in said ink.

* * * * *

UNITED STATES PATENT AND TRADEMARK OFFICE

CERTIFICATE OF CORRECTION

PATENT NO. : 5,353,051 Page 1 of 3

DATED : October 4, 1994

INVENTOR(S) : Akira KATAYAMA, et al.

It is certified that error appears in the above-indentified patent and that said Letters Patent is hereby corrected as shown below:

On the title page: Item

AT [56]:

Insert --Attorney, Agent or Firm - Fitzpatrick, Cella, Harper & Scinto--.

COLUMN 1:

Line 39, "ejected and heated by electric currents;" should read --heated by electric currents and ejected;--.

COLUMN 2:

Line 46, "with" should be deleted.

COLUMN 4:

Line 23, "invent ion;" should read --invention;--.

COLUMN 6:

Line 27, "CPU 4 6" should read --CPU 46--, and "an" should read --a--;

Line 29, "an" should read --a--.

UNITED STATES PATENT AND TRADEMARK OFFICE

CERTIFICATE OF CORRECTION

DATED : October 4, 1994

INVENTOR(S) : Akira KATAYAMA, et al.

It is certified that error appears in the above-indentified patent and that said Letters Patent is hereby corrected as shown below:

COLUMN 7:

Line 61, "full-multitype" should read --full-multi-type--.

COLUMN 9:

Line 5, "i . e. ," should read --i.e.,--, and "IC1-ICN." should read --drivers IC1-ICN.--.

COLUMN 11:

Line 3, "provide" should read --provided--;
Line 29, "Laying-open" should read --Laying-Open--;
Line 39, "plurality recording head" should read --plurality of recording heads--.

COLUMN 12:

Line 42, "hand copy." should read --hard copy.--;
Line 55, "form" should read --from--;
Line 56, "hand copy" should read --a hard copy--.

UNITED STATES PATENT AND TRADEMARK OFFICE

CERTIFICATE OF CORRECTION

PATENT NO. : 5,353,051

DATED : October 4, 1994

INVENTOR(S) : Akira KATAYAMA, et al.

It is certified that error appears in the above-indentified patent and that said Letters Patent is hereby corrected as shown below:

COLUMN 14:

Line 37, "plate;" should read --plate; and--.

Signed and Sealed this

Sixth Day of June, 1995

Bruce Lehman

*Attest:*

BRUCE LEHMAN

*Attesting Officer*

*Commissioner of Patents and Trademarks*